US006135883A

United States Patent [19]

Hachquet

[11] Patent Number: 6,135,883

[45] Date of Patent: Oct. 24, 2000

[54] DOUBLE DRAW ROYAL VIDEO POKER

[76] Inventor: Michael P. Hachquet, 499 Spring Valley Pl., Elko, Nev. 89801

[21] Appl. No.: 09/452,447

[22] Filed: Dec. 2, 1999

Related U.S. Application Data

[62] Division of application No. 09/108,422, Jun. 30, 1998, Pat. No. 6,050,568.

[51] Int. Cl.[7] ..... A63F 1/00

[52] U.S. Cl. ..... 463/13; 273/292

[58] Field of Search ..... 463/13; 273/292, 273/274, 309

[56] References Cited

U.S. PATENT DOCUMENTS

| | | | |
|---|---|---|---|
| 4,743,022 | 5/1988 | Wood | 273/85 |
| 4,799,683 | 1/1989 | Bruner, Jr. | 273/138 |
| 4,948,134 | 8/1990 | Suttle et al. | 273/85 |
| 5,100,137 | 3/1992 | Fulton | 273/85 |
| 5,332,228 | 7/1994 | Schultz | 273/292 |
| 5,356,140 | 10/1994 | Dabrowski et al. | 273/85 |
| 5,531,441 | 7/1996 | Dabrowski et al. | 463/12 |
| 5,823,873 | 10/1998 | Moody | 463/13 |
| 5,879,233 | 3/1999 | Stupero | 463/11 |
| 6,007,006 | 12/1999 | Moody | 273/292 |
| 6,050,568 | 4/2000 | Hachquet | 273/292 |

*Primary Examiner*—Jessica J. Harrison
*Assistant Examiner*—Julie Kasick
*Attorney, Agent, or Firm*—Jacobson, Price, Holman & Stern, PLLC

[57] ABSTRACT

A video poker game in which a player is dealt two identical poker hands from separate identical card decks by displaying the dealt card images on a video screen. This enables the player to play each of the identical hands in accordance with the cards dealt in each hand and the players acuity in choosing the best strategy to obtain winning hands. This provides a player with more choices in playing strategies by enabling the player to hold or draw different cards in each hand, play both hands in the same manner, play both hands in different manners or fold a weaker hand and play a stronger hand. Winning hands will receive a payout according to a pay schedule with a bonus being awarded when a player draws to a royal flush in both hands.

2 Claims, 1 Drawing Sheet

DOUBLE DRAW ROYAL VIDEO POKER

This is a divisional application of Ser. No. 09/108,422, filed Jun. 30, 1998, now U.S. Pat. No. 6,050,568.

BACKGROUND OF THE INVENTION

1. Field of the Invention

The present invention relates to a poker game in which a player is dealt two identical poker hands from separate standard fifty-two card decks. This enables the player to play each of the identical hands in accordance with the cards dealt in each hand and the players acuity in choosing the best strategy to obtain winning hands. This provides a player with more choices in playing strategies by enabling the player to hold or draw different cards in each hand, play both hands in the same manner, play both hands in different manners. Winning hands will receive a payout according to a pay schedule. The double draw feature may also be utilized in identical decks containing one or more wild cards which thereby increase the number of cards in a deck.

2. Description of the Prior Art Various card games are played by dealing cards from a deck or decks to players who endeavor to obtain a winning hand by following various strategies. Video game poker has been developed as a substitute for or adjunct to a dealer actually dealing cards from a card deck. Various rules of play are utilized in playing poker hands whether playing with actual cards or video illustrations of card faces.

The following U.S. patents relate to this invention.

| | |
|---|---|
| 4,743,022 | 5,332,228 |
| 4,799,683 | 5,356,140 |
| 4,948,134 | 5,531,441 |
| 5,100,137 | |

The above patents disclose various poker games which can be played either as a table game with actual cards being dealt or as a video game. In either type of game, cards are dealt from a standard deck and players play their hands in accordance with various rules of play and well known strategies. Video poker is played using the same well known strategies but cards are not actually dealt. Rather, images of the card faces are displayed on viewing screens accessible to the players.

The patent to Wood 4,743,022 discloses a poker game in which a player receives an initial hand of five cards and has the option of discarding up to any five cards and have them replaced thereby forming a second hand. The player is entitled to make a second wager and receive a sixth card and continues to play in accordance with predetermined rules.

The patent to Bruner 4,799,683 discloses a conventional draw poker game which can be played on a color television receiver interchangeably with a broadcast program on the receiver.

The patent to Suttle et al. 4,948,134 discloses a poker game in which a player and a dealer are each dealt a five card poker hand with one of the dealer's cards being face up. A player or players can then wager or fold with all dealer cards then being revealed in order to determine a winner.

The patent to Fulton 5,100,137 discloses a poker game in which an initial hand of four cards is dealt which enables an additional wager to be made and display of a fifth card which is compared with various winning combinations to determine the outcome of a poker game.

The patent to Schultz 5,332,228 discloses a poker game in which cards are dealt including one card designated as a "wild card" at variable positions in the hand with any additional cards in the hand that are identical to the "wild card" also being considered "wild" thereby providing various choices and strategies in playing a poker game.

The two patents to Dabrowski 5,356,140 and 5,531,441 disclose the concept of dealing two separate five card poker hands from separate standard fifty-two card decks that are identical and in the identical sequence. However, a player must select either the first dealt hand or the second dealt hand to continue play. When two identical hands with the cards being in the same sequence are dealt, then a winner is immediately determined without further play.

The above patents do not disclose playing two identical hands dealt from separate standard decks to a conclusion by using the same strategies in connection with each hand or using different strategies in connection with each hand.

SUMMARY OF THE INVENTION

An object of the present invention is to provide a poker game enabling players of the game to have more choices and utilize more strategies when endeavoring to obtain a winning hand or hands. Accordingly, it is an object of the present invention to provide a poker game in which a player is dealt identical hands from two separate identical card decks which enables a player to play each hand by making all of the choices and following all of the strategies normally used in playing a single five card hand.

Optionally, another object of the present invention is to provide a poker game in accordance with the preceding object in which a bonus payout is provided when a player draws a royal flush in both hands.

A further object of the present invention is to provide a poker game in accordance with the preceding objects in which both hands are displayed on a video monitor and are played and awarded as two individual hands.

Still another object of the invention is to provide a poker game in accordance with the preceding objects in which the separate decks from which the hands were dealt are mixed or shuffled so that cards drawn from one of the decks may be different from cards drawn from the other of the decks thereby enabling the player to play two identical hands with different strategies by holding different cards in each hand or playing both hands the same and having the chance to draw from the remaining cards in each deck thus allowing the player a chance to draw and improve each hand from its original deck.

Yet another object of the invention is to provide a video poker game which will automatically hold cards for optimum play but the player may change hold or draw cards on either or both hands in order to increase the speed of playing the game with each winning hand being paid according to a pay schedule.

These together with other objects and advantages which will become subsequently apparent reside in the details of construction and operation as more fully hereinafter described and claimed, reference being had to the accompanying drawings forming apart hereof, wherein like numerals refer to like parts throughout.

DESCRIPTION OF THE PREFERRED EMBODIMENT

Figure 1:
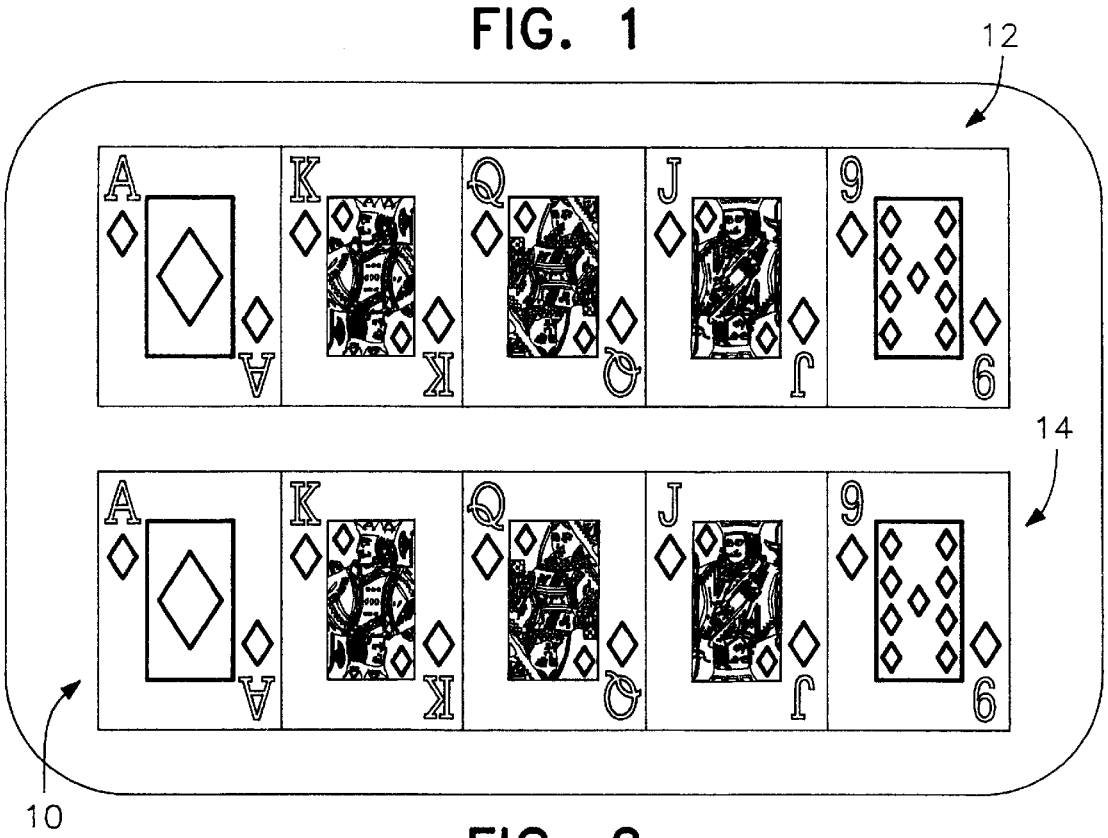
FIG. 1 illustrates two identical five card poker hands which have been dealt from separate identical card decks and illustrated on a video monitor.

Although only one preferred embodiment of the invention is explained in detail, it is to be understood that the invention is not limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

Figure 2:
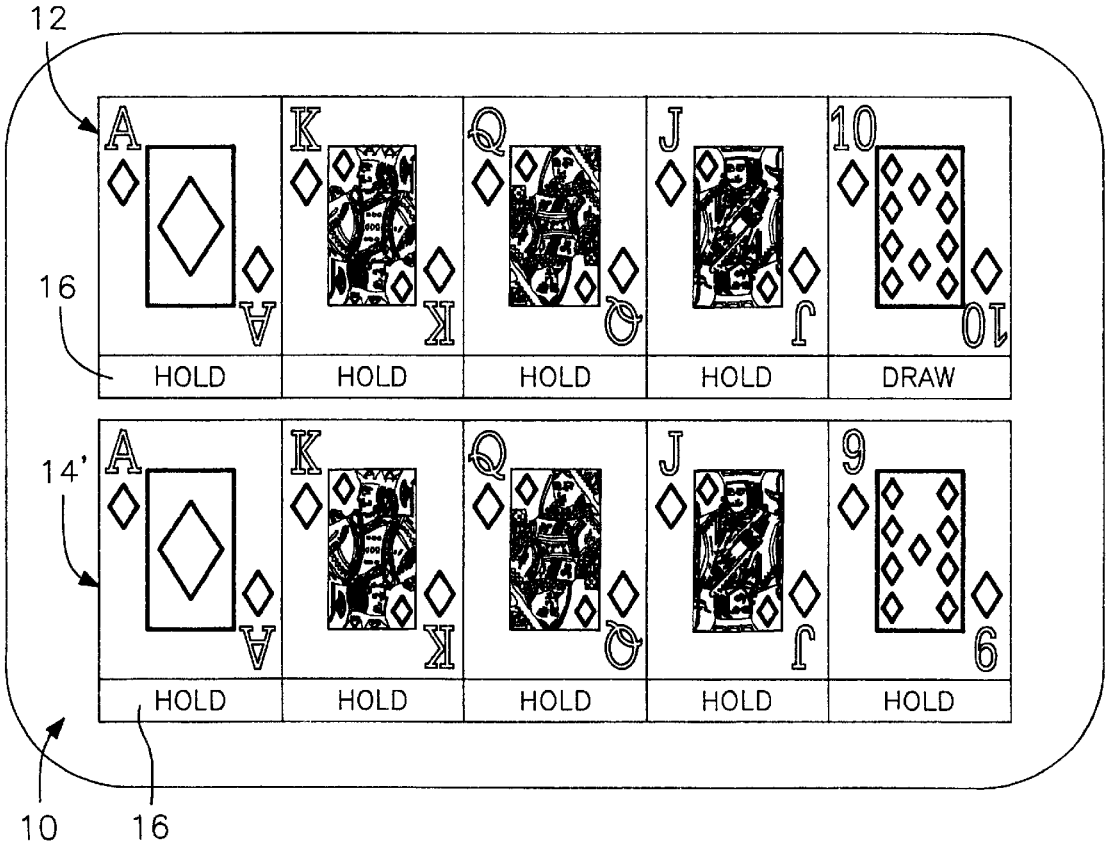
FIG. 2 illustrates the play strategy in which one card in one hand has been replaced by drawing another card.

Referring specifically to the drawings, FIG. 1 illustrates schematically a monitor screen 10 having the images of two identical five card poker hands generally designated by reference numerals 12 and 14 which have been dealt from separate identical card decks. The hands 12 and 14 are identical with each hand including the ace, king, queen, jack and nine of diamonds. After the two identical hands 12 and 14 have been dealt, the player can decide the strategy to be followed in playing each of the hands. FIG. 2 illustrates the two hands 12' and 14' and also includes indicia 16 below each of the illustrated cards in each of the hands to indicate the result of the choices made by the player. The hand 14' in FIG. 2 is identical to the hand 14 in FIG. 1 and the indicia 16 under each of the cards in hand 14' indicates that each of the cards in hand 14' has been held. However, hand 12' in FIG. 2 is different from the hand 12 in FIG. 1 with the indicia 16 indicating that the ace, king, queen, and jack of diamonds have been held and a new card has been drawn from the mixed deck from which hand 12 was originally dealt. The word "HOLD" appears under each held card and the word "DRAW" appears under the card that was drawn and the card that was drawn is the ten of diamonds. Thus, as a result of the strategy of the player, hand 12' after discarding the nine of diamonds and drawing the ten of diamonds is a stronger and more likely winning hand as compared to hand 12 illustrated in FIG. 1. The double draw feature of the present invention provides the player with more choices and the ability to use more than one strategy on playing a hand. For example, a player may be faced with a choice in a single draw poker hand of drawing for a royal or keeping a flush. With the double draw feature of this invention, the player has the option of doing both. By giving the players more choices and more ways to win, the double draw feature creates additional entertainment and excitement for the players and more revenue for the gaming establishment.

The rules of playing the double draw video poker are as follows:

The Deal-The video poker game deals two identical five card poker hands 12 and 14 from two identical card decks. The first five cards 12 are dealt from deck "A" and the same first five cards 14 are dealt from deck "B". The initial five cards in both hands are the same. Both hands are displayed on the monitor 10 and are played and awarded as two individual hands.

The Draw-Each hand is its own individual hand. Deck "A" and deck "B" are mixed and randomly different. The draw from deck "A" to hand 12' and deck "B" to hand 14' may be different. This enables the player to play two identical hands with different strategies by holding different cards in each hand or play both hands the same and having the chance to draw from the remaining cards in each deck. This allows the player a chance to draw and improve each hand from separate decks. They are two separately played and awarded hands.

The game will automatically hold cards for optimum play but the player may change hold or draw cards on either or both hands. This will increase the speed of the game.

The Award-Each winning hand is paid according to a pay schedule. The awarded hands coincide with standard video poker games. The pay schedule will vary depending on the desired win percentage by location or manufacture.

Double Draw Bonus Awards-Optionally, the Double Draw Royal Bonus is awarded when the player draws a royal flush on both hands. Cards must be drawn to the royal flush to be awarded the Double Draw Royal Bonus. The award for the Double Draw Royal would be determined by the operator and/or the manufacture. In the case the royal flush is dealt with the first initial five cards, giving both hands a royal flush, and no cards were drawn, the award would be the amount from the pay schedule for royal flush, not the Double Draw Royal Bonus.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An apparatus for playing a poker game comprising:

means for displaying to a player a first five card poker hand from a first deck of playing cards;

means for displaying to said player a second five card poker hand from a second deck of playing cards, said first five card poker hand being identical to said second five card poker hand, wherein each card of suit and value in said first five card poker hand having an identical card of suit and value in said second five card poker hand;

means activated by said player for playing each five card poker hand independently by standing on the first five card poker hand or discarding one or more cards from the first five card poker hand and drawing additional cards from the first deck of playing cards to replace the discarded cards from the first five card poker hand, then standing on the second five card poker hand or discarding one or more cards from the second five card poker hand and drawing additional cards from the second deck of playing cards to replace the discarded cards from the second five card poker hand.

2. The apparatus of claim 1 wherein said first and second decks of playing cards are conventional decks each containing 52 playing cards.

* * * * *